United States Patent [19]

Mariol

[11] 4,215,509

[45] Aug. 5, 1980

[54] ANIMATED TOY BLOCK SET

[75] Inventor: James F. Mariol, Cincinnati, Ohio

[73] Assignee: Design Alliance, Inc., Cincinnati, Ohio

[21] Appl. No.: 923,176

[22] Filed: Jul. 10, 1978

[51] Int. Cl.[2] ..... A63H 33/00

[52] U.S. Cl. ..... 46/22

[58] Field of Search ..... 46/22, 24, 27, 30, 23, 46/161, 16, 17; 35/73, 69

[56] References Cited

U.S. PATENT DOCUMENTS

| | | | |
|---|---|---|---|
| 211,528 | 1/1879 | Shelton | 46/22 |
| 1,209,440 | 12/1916 | Humbert | 46/22 |
| 1,345,052 | 6/1920 | Williams | 46/161 |
| 1,430,557 | 10/1922 | Jervis | 46/22 |
| 1,481,129 | 1/1924 | French | 46/22 |
| 2,011,714 | 8/1935 | Friedman | 46/22 UX |

*Primary Examiner*—Louis G. Mancene
*Assistant Examiner*—Mickey Yu
*Attorney, Agent, or Firm*—Wood, Herron & Evans

[57] ABSTRACT

A multiple block set to be assembled into multiple different positions of an animated character. At least one of the blocks includes a portion of the body shaped as a cube from which an appendage of an animal character extends and at least some of the other blocks have flat square surfaces engageable with the cubular section of the one block to enable the blocks to be stacked without the use of connectors in multiple different positions.

7 Claims, 27 Drawing Figures

ANIMATED TOY BLOCK SET

This invention relates to toy block sets and particularly to multiple position animated toy block sets.

At the present time there are on the market and in published literature any number of toy block sets, many of which enable animated characters to be assembled in different positions from selected ones of the blocks. One example of such a multiple position animated block set may be found in U.S. Pat. No. 1,481,129. For the most part though these multiple position animated block sets all require connectors, pegs, etc., to hold the blocks in an assembled position. Consequently, they are too difficult for many young children to use and assemble.

It has been an objective of this invention to provide a toy block set which is as easy to assemble as the old fashioned wooden A B C blocks but which is substantially more interesting and usable by a slightly older child than those A B C blocks. The old fashioned A B C blocks are nothing more than wooden cubes with different alphabetical letters printed on the sides. Their strength and the primary reason they are still popular after at least a century of use is that they are so easy to assemble into different assemblages and patterns and even very young children may use and be entertained by them. But their shortcoming is that these blocks are usable and entertaining to only a very narrow range age of child and then only for a relatively short time span, until the child has outgrown the toy.

It has therefore been an objective of this invention to provide a toy block set which is interesting to children who have outgrown the A B C block set but who have not yet developed motor skills sufficient to enable them to do much more than set one block upon another.

I have achieved this objective and this invention is predicated upon the concept of a toy block set which can be assembled into multiple different positions of an animated character by simply stacking one block upon another. The blocks are so configured and shaped that they will retain their different stacked assembled positions without the aid of any connectors or fasteners. Because there are no connectors or fasteners operative between the blocks, even very young children with relatively little motor skill can play with the block sets and assemble them into different configurations.

To facilitate this ease of assembly and multiple position stackability of an animal character block set, the set is so configured that a body portion of at least one block of the set is shaped as a cube and has an animal character appendage, such as an arm, leg, or tail extending from it. Because of its cube shape, this one body position block may be stacked relative to the other blocks to assume multiple different positions of the animal characters.

In one preferred embodiment, a three block set assembles into multiple different positions of a puppy. In this set the head is formed from one block, the front body sections and front legs from another block, and the rear body section and rear legs from another block. The front body section is formed on a cube from which the front legs extend and the head is formed as a portion of a cube which may be nested in two different positions on the cubular shaped front body section. This three block set may be stacked or assembled into at least ten different positions of the puppy depending upon which of the cubular surfaces of the front body section contacts the cubular surfaces of the head and rear body section.

In another preferred embodiment, a three block set assembles into multiple different positions of a chicken. In this embodiment, the head extends from a cubular shaped front body section, the tail protrudes from a cubular shaped rear body section, and the front and lower body form the third section. By varying the contacting surfaces of the cubular sections of the body, this three piece set may be assembled into at least ten different positions of the chicken character.

Still a third preferred embodiment, either a five or eight block set, assembles into multiple different positions of a small boy or small girl. In this embodiment the body of the boy or girl comprises four cubes, from two of which legs extend downwardly and the two others of which arms extend outwardly. The fifth block is the head and neck which has a flat lower surface positionable on the top of the cubular shaped upper body sections. In addition to these five pieces or blocks, the set may optionally include a rectangular solid shaped (technically a rectangular parallelepiped shaped) central body block and two generally rectangular solid shaped foot blocks. This five or eight block set may be assembled in a very large number of different assembled positions of the boy or girl character depending upon the relative contacting surfaces of the generally cubular shaped body sections.

The primary advantage of this block set is that it has no connectors or fasteners associated with it so that it is very easy to assembly, and yet is more interesting and has more variety associated with it than prior art stacking type cubular block sets.

These and other objects and advantages of this invention will be readily apparent from the following description of the drawings in which.

Figure 1:
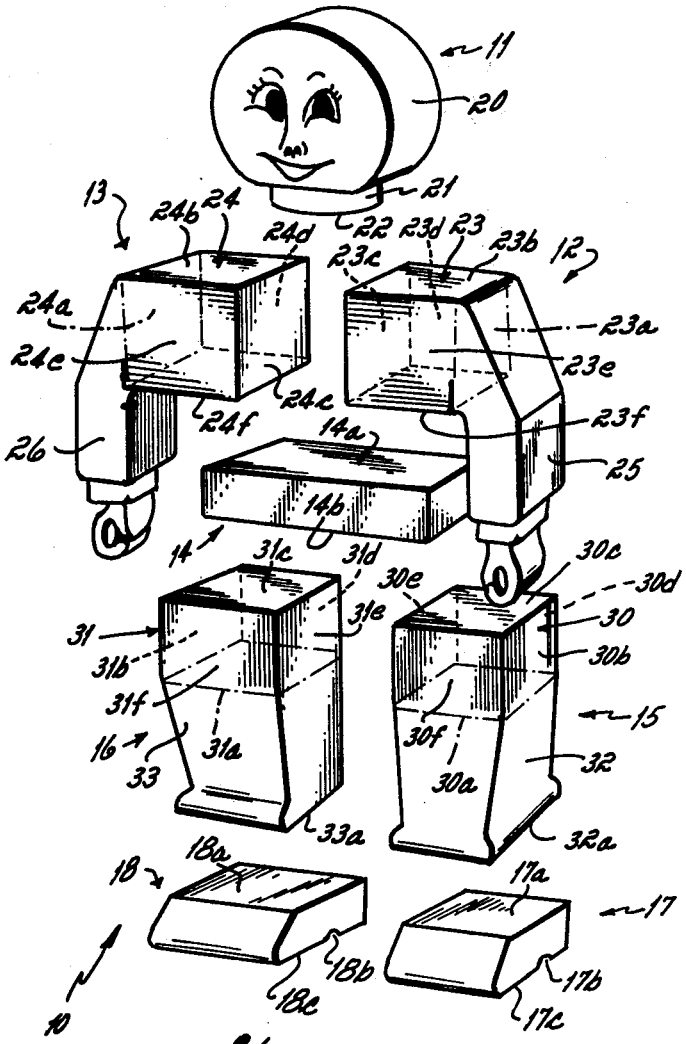
FIG. 1 is an exploded perspective view of a toy block set incorporating the invention of this application.
Figure 2:
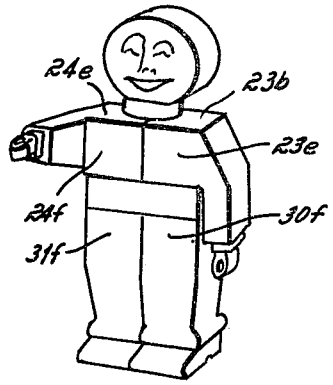
FIGS. 2–18 are perspective views of the block set illustrated in FIG. 1 but showing the set assembled into different positions.
Figure 3:
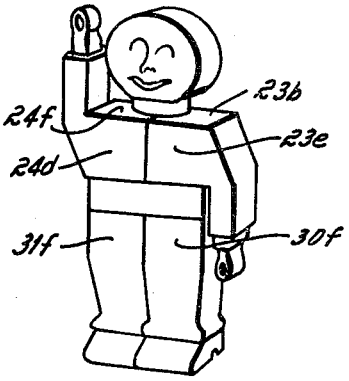
Figure 4:
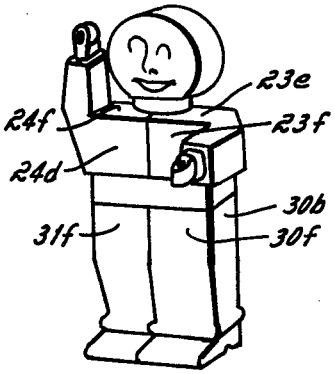
Figure 5:
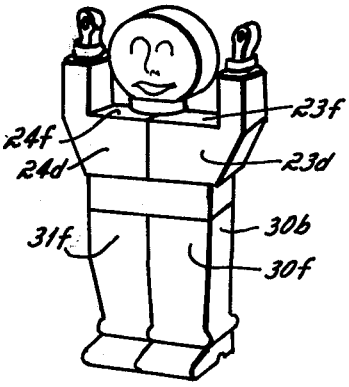
Figure 6:
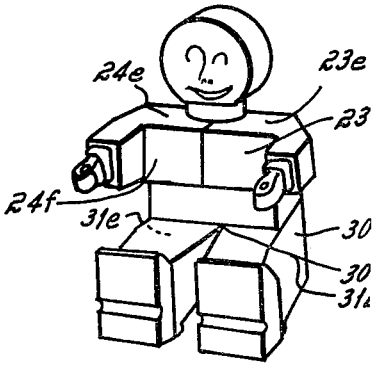
Figure 7:
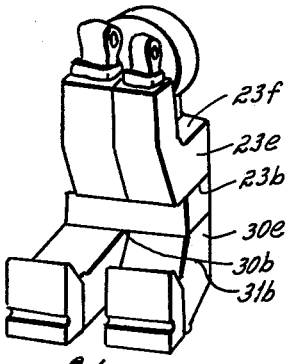
Figure 8:
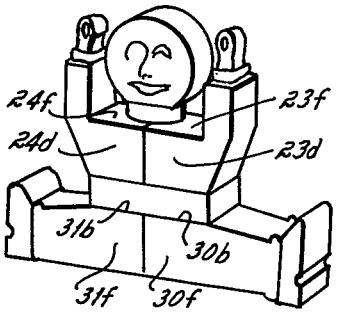
Figure 9:
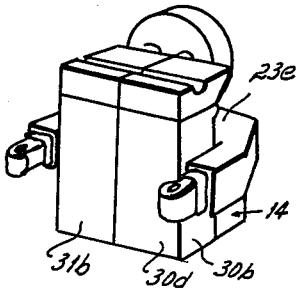
Figure 10:
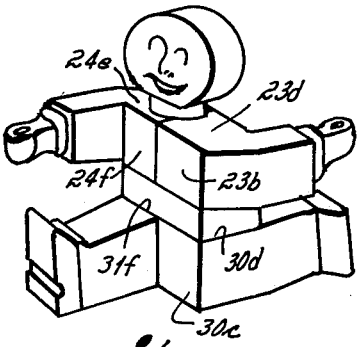
Figure 11:
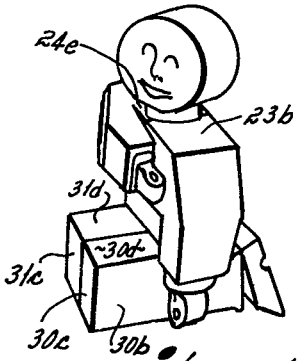
Figure 12:
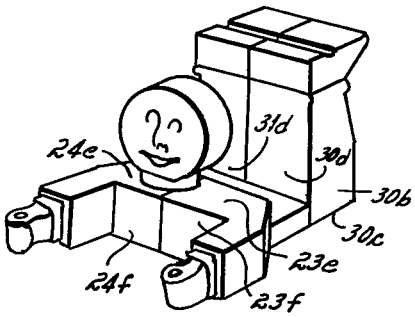
Figure 13:
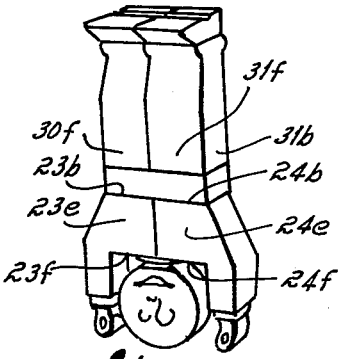
Figure 14:
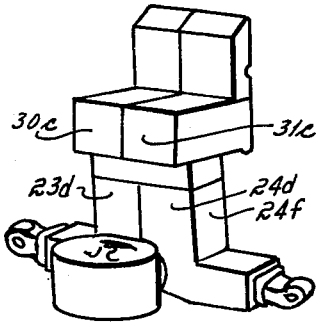
Figure 15:
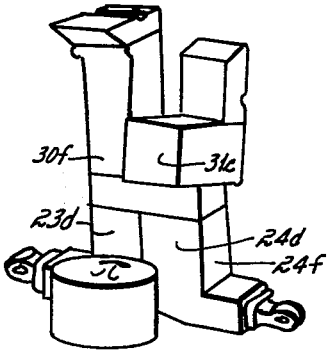
Figure 16:
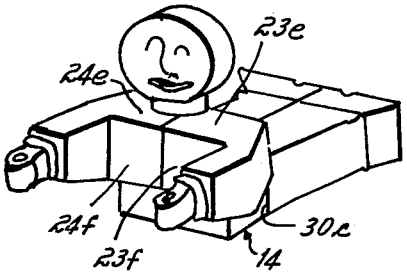
Figure 17:
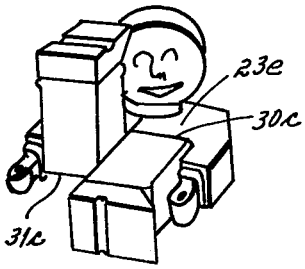
Figure 18:
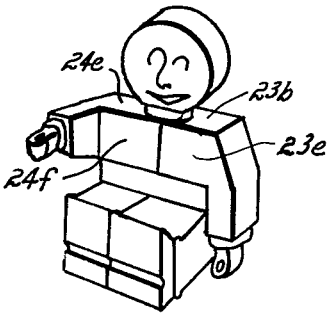

Referring first to FIG. 1, there is illustrated a first embodiment of a toy block set 10 incorporating the invention of this application. This eight-piece block set comprises a head block 11, two upper body and arm section blocks 12 and 13, a central body section block 14, two lower body and leg section blocks 15 and 16, and two foot blocks 17 and 18. These eight blocks are so configured that they may be stacked one upon the other to form an animated character in multiple different positions, in this instance a small boy in a very large number of different positions. Several of the different positions into which the small boy character may be assembled by stacking the blocks 11–18 in different relative positions are illustrated in FIGS. 2–21.

Referring now to FIG. 1, it will be seen that the head block generally comprises a cylindrical head section 20 from which a neck 21 having a flat bottom surface 22 depends. Because the bottom surface 22 of the neck 21 is flat, it may rest upon any flat surface of the upper body blocks 12 and 13 to enable the character to be assembled into different positions.

Each of the upper body blocks 12 and 13 comprises a cubular section 23 or 24 from one side 23*a* or 24*a* of which an upper body appendage, in this instance an arm 25, 26, extends outwardly. It is to be noted that the upper body cubular sections 23, 24 have five sides 23*b*–23*f* and 24*b*–24*f* which are shaped as squares. The arms extend outwardly from the sixth side 24*a*. Because there are 5 square sides on each of these blocks 12, 13, they may be assembled with any of the square sides positioned adjacent any of the square sides of the other blocks to enable the arms to be located in multiple different positions relative to each other and/or relative to the head and central body sections 11 and 14 respectively.

Central body section 14 comprises a rectangular solid (or technically a rectangular parallelepiped) having top and bottom sides 14*a* and 14*b* of twice the area of any one square side of the upper body cubular sections 23 and 24. Consequently one square side of each of the upper body cubular sections 23, 24 fit upon the top surface 14*a* (or bottom surface 14*b*) of the central body section block 14.

The lower body and leg blocks 15 and 16 each comprise a cubular lower body section 30, 31 from one side 30*a*, 31*a* respectively of which a leg section 32, 33 extends downwardly. Each of the lower body sections 30–31 has five square sides 30*b*–30*f*, 31*b*–31*f*, anyone of which may be placed in juxtaposition to one of the five square sides of the other lower body section to enable the blocks 30, 31 to be positioned in multiple different positions relative to each other. Thereby, the leg appendage extending from the cubular lower body sections 30, 31 may be positioned in multiple different positions relative to each other, as illustrated in FIGS. 2–21.

The foot-shaped blocks 17 and 18 are generally shaped as rectangular solids having an upper surface 17*a*, 18*a* of the same area and configuration as the bottom surfaces 32*a*, 33*a* of the leg sections 32, 33 of the blocks 15 and 16. These foot blocks 17 and 18 also have a tapered front section and a recess 17*b*, 18*b* in the bottom surface 17*c*, 18*c* to give the appearance of having the heel separated from the front portion of the foot.

Referring now to FIGS. 2–18, it will be seen that the cubular shaped upper body cubular sections 23, 24 of the blocks 12 and 13 and the cubular shaped sections 30, 31 of the lower body blocks 15 and 16 have appendages, either in the forms or arms and legs, extending outwardly from a one of the six sides of the cubular shaped blocks. This cubular configuration enables those blocks to be positioned in multiple different positions relative to each other. Specifically, the square sides of those blocks may be positioned in multiple different contacting positions relative to each other, either with or without the inclusion of the rectangular block 14 therebetween, so as to enable the arms and legs of the boy character to be located in numerous different positions relative to each other.

Figure 19:
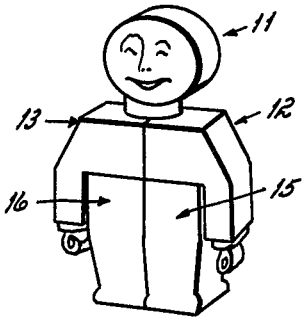
FIGS. 19–21 are perspective views of the block set of FIG. 1 but omitting three of the blocks.
Figure 20:
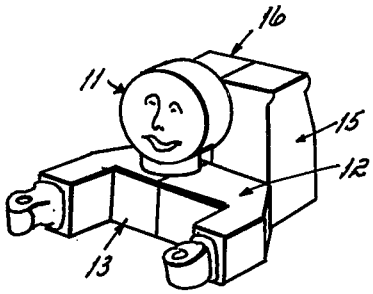
Figure 21:
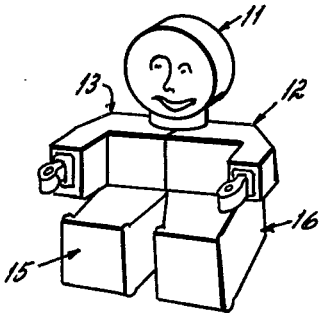

Referring now to FIGS. 19–21, it will be seen that the rectangular central body block 14 and the foot blocks 17 and 18 of the block set 10 may be omitted and the set still assembled into multiple different positions because of the inclusion of the four blocks 12, 13, 15 and 16, having cubular body sections adapted to be positioned in multiple different contacting relations with each other. So long as these four blocks are included, their attached appendages may be arranged in multiple different positions of the block set 10.

Figure 22:
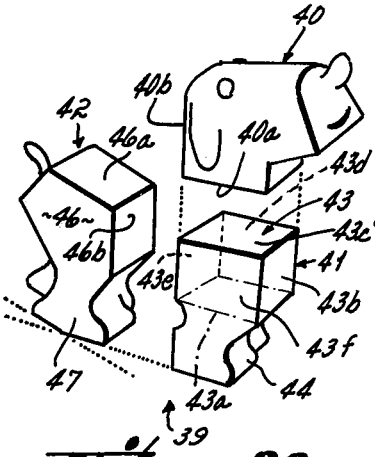
FIG. 22 is an exploded persepctive view of a second embodiment of the invention.

Referring now to FIG. 22, there is illustrated a three block set 39 which may be assembled into multiple different positions of a puppy dog. In this set the first block 40 is shaped as the head of the dog, the second block 41 is shaped as the front body section and front legs, and the third block 42 is shaped as the rear body section and rear legs.

There is only a single block 41 in the set 39, which has a body portion shaped as a cube 43. One side 43*a* of this cubular body section 43 has the legs 44 depending from it. The other five sides 43*b*–43*f* of the cubular body section 43 are all square and are adapted to be engaged with a similarly shaped and sized square side 40*a* on the bottom or a flat surface 40*b* on the head block 40 to vary the position of the head relative to the body.

The rear body block 42 comprises the body section 46 from which the rear legs 47 depend. The body section 46 of the block is shaped as a portion of a cube and has two square sides 46*a*, 46*b* of the same size as the square sides of the cubular front body section 43 of block 41 which are adapted to be alternately placed in juxtaposition to the square sides of the cubular section 43.

Figure 23:
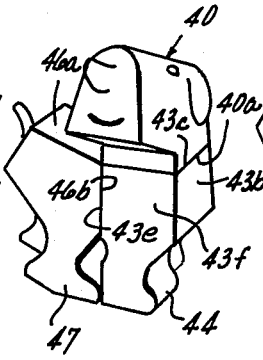
FIGS. 23–25 are perspective views of the block set of FIG. 22 but illustrating different assembled positions of the blocks.
Figure 24:
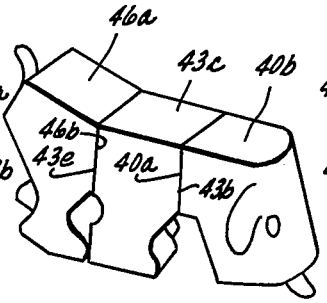
Figure 25:
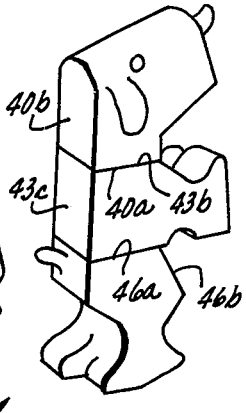

Referring now to FIGS. 23–25, it will be seen that the three block puppy dog set of FIG. 22 may be assembled into at least 10 different positions although only 4 different ones are illustrated in these figures. These multiple different positions are primarily attributable to the cubular shape of the front body section 43 of the block 41 which may be engaged with multiple different flat surfaces of the rear body section 46 and head section 40. Of course, the more square sections on the other blocks engageable with the cubular section 43 of the block 41, the more positions the animated character may be moved into by repositioning the square surfaces in engagement with other square surfaces of the other blocks.

Figure 26:
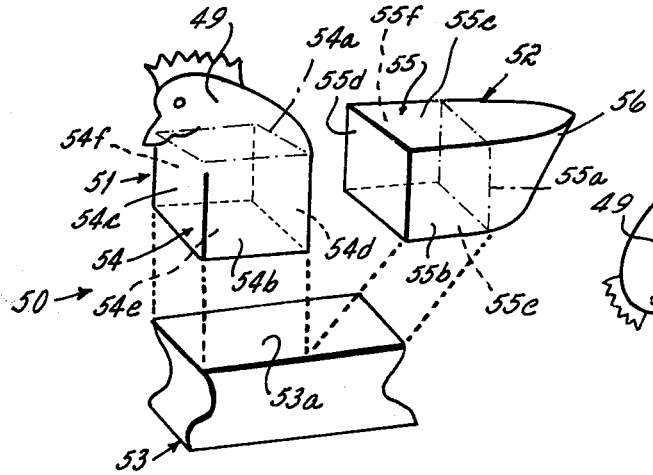
FIG. 26 is an exploded perspective view of a third embodiment of the invention.
Figure 27:
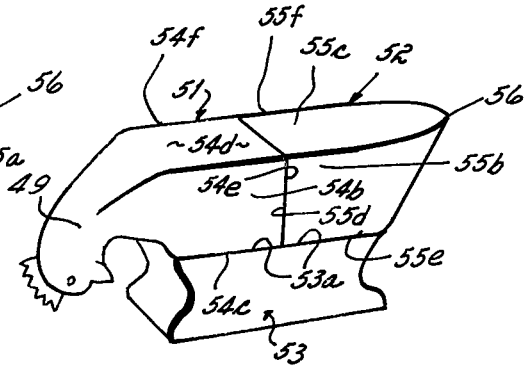
FIG. 27 is a perspective view of the block set illustrated in FIG. 26 but in an alternate position.

Referring now to FIGS. 26 and 27, there is illustrated still a third embodiment of the invention of this application. This third embodiment is also a three-block set 50 in which one block 51 is shaped as the front body and head of a chicken; another block 52 is shaped as the rear body section and tail of the chicken, and the third block 53 is shaped as the lower body section and legs of the chicken. In this embodiment, the front body section 51 is shaped as a cube 54 from one square side of which 54*a* the head 49 of the chicken extends upwardly. The other five sides of this cubular block 54, 54*b*–54*f* are all square and engageable with similarly shaped and sized portions of the other blocks.

The rear body and tail block 52 also is shaped as a cube 55 from one square side of which 55*a* the tail 56 extends. The other five sides 55*b*–55*f* are all square in configuration and of the same size as the square sides of the cubular section 54 of the block 51 such that they may be engaged with that block to assemble the chicken into multiple different positions.

The lower or bottom block 53 of this three-piece chicken set 50 has a flat upper surface 53*a* shaped as a rectangle having twice the area of any of the square sides of the blocks 51 or 52. In all positions of this set, this lower block 53 is intended to support one of the square sides of each of the blocks 51, 52.

As in the three-block set of FIG. 22, this three-block set illustrated in FIGS. 26 and 27 is capable of being assembled into multiple different positions of the animated character; specifically, by juxtapositioning different ones of square sides of the blocks 50, 51 adjacent one another, and on top of the top surface 53*a* of the lower block 53, this three-block set may also be assembled into at least ten different positions of the chicken.

In all three different embodiments of the block sets described hereinabove a portion of the body is shaped as a cube from one side of which an appendage of the animated character, be it a boy, a chicken, or a dog, extends. The other blocks of the set in every instance have multiple surfaces shaped as squares or rectangles engageable with the square sides of the first block so that the set of blocks may be stacked and thereby assembled into multiple different positions of the animated character. Because there are no connectors required between the blocks to maintain them in an assembled relation, the motor skills required of a child to assemble them into the different positions is minimal, and consequently this block set may be used and enjoyed by very young children who lack the requisite motor skills to use connectors and fasteners generally employed in prior art multiple position animated toy block sets.

While I have described only three different embodiments of my invention, persons skilled in this art will appreciate numerous changes and modifications which may be made without departing from the spirit of my invention. Therefore, I do not intend to be limited except by the scope of the appended claims.

Having described my invention, I claim:

1. An animated toy block set capable of being assembled into multiple different positions of an animal character utilizing the same combination of blocks but in multiple different relative positions to effect the different positions of the animal character, said set comprising at least three blocks, at least two of said three blocks having a portion of the body and an appendage of the animal character integrally formed thereon, said body portion of said two blocks being shaped as a cube, from which said appendage extends, and said blocks being adapted to rest in an assembled relation forming the complete animal character and being adapted to be altered in position relative to one another to vary the position of the animal character.

2. The animated toy block set of claim 1 in which each of said blocks is weighted such that it will remain in any of a plurality of assembled positions relative to the other blocks without the aid of any fasteners or securements between the blocks.

3. The animated toy block set of claim 1 in which the body portion of said two blocks has at least two sides shaped as a square.

4. The animated toy block set of claim 1 in which the body portion of at least one of said two blocks has five sides shaped as a square and the appendage of said block extending from a sixth side.

5. An animated toy block set comprising at least three blocks, at least two of said blocks having a portion which is cubular in shape and having at least two sides which are square in configuration, said two blocks having an appendage of an animal integrally forward thereon and extending from one side thereof, at least one of said two cubular blocks including a portion which forms the body of the animal created by the assembled block set, said blocks being adapted to rest in an assembled relation forming a complete animal and being adapted to be altered in position relative to one another while utilizing the same combination of blocks to vary the position of the animal, and all of said blocks being weighted such that they remain in various assembled positions relative to one another without the aid of any fasteners or securements between the blocks.

6. An animated toy block set comprising at least three blocks, at least one of said blocks having five sides which are generally square in configuration and having an appendage of an animal extending from a sixth side thereof, said one block including a portion which forms the body of an animal created by the assembled block set, said blocks being adapted to rest in an assembled relation forming a complete animal and being adapted to be altered in position relative to one another while utilizing the same combination of blocks to vary the position of the animal, and said blocks all being weighted such that they remain in various assembled positions relative to one another without the aid of any fasteners or securements between the blocks.

7. An animated toy block set comprising at least three blocks, at least one of said blocks being shaped as a cube having an appendage of an animal extending from one side thereof, said one block including a portion which forms the body of an animal created by the assembled block set, said blocks being adapted to rest in an assembled relation forming a complete animal and being adapted to be altered in position relative to one another while utilizing the same combination of blocks to vary the position of the animal, and said blocks being weighted such that they remain in various assembled positions relative to one another without the aid of any fasteners or securements between the blocks.

* * * * *